US009661877B2

(12) United States Patent
Bao

(10) Patent No.: US 9,661,877 B2
(45) Date of Patent: May 30, 2017

(54) CIGARETTE TUBE INJECTOR

(71) Applicant: Fan Bao, Walnut, CA (US)

(72) Inventor: Fan Bao, Walnut, CA (US)

( * ) Notice: Subject to any disclaimer, the term of this patent is extended or adjusted under 35 U.S.C. 154(b) by 382 days.

(21) Appl. No.: 13/999,352

(22) Filed: Feb. 13, 2014

(65) Prior Publication Data

US 2015/0223519 A1 Aug. 13, 2015

(51) Int. Cl.
*A24C 5/06* (2006.01)
*A24C 5/42* (2006.01)

(52) U.S. Cl.
CPC . *A24C 5/06* (2013.01); *A24C 5/42* (2013.01)

(58) Field of Classification Search
CPC .... A24C 5/02; A24C 5/04; A24C 5/06; A24C 5/40; A24C 5/42; A24C 5/425
See application file for complete search history.

(56) References Cited

U.S. PATENT DOCUMENTS 4,620,551 A * 11/1986 Ruppert ..... A24C 5/42 131/70
8,387,622 B1 * 3/2013 Moscovitch ..... A24C 5/42 131/70
2010/0229880 A1 * 9/2010 Bao ..... A24C 5/42 131/70
2013/0276795 A1 * 10/2013 Yang ..... A24C 5/06 131/70

* cited by examiner

*Primary Examiner* — Michael H Wilson
*Assistant Examiner* — Eric Yaary
(74) *Attorney, Agent, or Firm* — Raymond Y. Chan; David and Raymond Patent Firm

(57) ABSTRACT

A cigarette tube injector includes a pocket casing and a cigarette filling arrangement. The pocket casing has a tobacco cavity defining a top opening for disposing tobacco leaves at the tobacco cavity, and a feeding opening for a cigarette paper tube alignedly supporting thereat. The cigarette filling arrangement includes a feeding pusher slidably supported at the pocket casing to move along a transverse direction thereof for pushing the tobacco leaves at the tobacco cavity, and a slide spoon slidably coupled at the pocket casing at an injection direction to align with the feeding opening, wherein the feeding pusher is moved toward the slide spoon for pushing the tobacco leaves to the slide spoon, such that the slide spoon is slid for feeding the tobacco leaves at the tobacco cavity into the cigarette paper tube through the feeding opening.

2 Claims, 10 Drawing Sheets

CIGARETTE TUBE INJECTOR

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to a cigarette tube injector, and more particularly to a cigarette tube injector which not only can make a tight and even injection to have a better quality of cigarettes, but also has an ultra compact size for enhancing the portability of the cigarette tube injector.

Description of Related Arts

The cigarettes consumed by people are normally manufactured by factories and are sold in market. A cigarette is a paper wrapped tube stuffed with finely cut tobacco leaves. Generally the tobacco leaves are cured and processed with addictives. There are many tastes and brands of cigarettes people can select because of the different types of tobacco leaves, different cure processes and addictives. But still some people want to smoke their own tobaccos.

For those people using their own tobaccos, they have to prepare their own cigarettes by rolling the paper to wrap their cut tobacco leaves inside. Doing this by hands takes a lot of time, and it is also difficult to stuff the tobacco leaves with a uniform and proper compactness. If the tobacco leaves are wrapped too compressed, it is difficult to smoke; if the tobacco leaves are wrapped too loose, it is easy to drop the tobacco leaves, and get the cigarette extinguished.

Currently there are machines can help people to make cigarettes with their own tobaccos, but there are some problems preventing these machine be used conveniently. Some of these machines still need the user to use hands. For example, a manual crank-type machine can be operated manually by filling the tobacco leaves into the crank nozzle such that when the crank nozzle is inserted into the cigarette paper tube, the tobacco leaves loaded therein. The advantage of the manual crank-type machine is that the tobacco leaves will not be shredded when the tobacco leaves are loaded in the cigarette paper tube. However, one of the drawbacks of the manual crank-type machine is that the injection is not automatic. The user has to use both hands and provides force. It is not convenient to use. Another drawback is that the tobacco leaves cannot be evenly loaded within the cigarette paper tube such that compactness of the cigarette is not uniform.

Some machines are driven by electric power. The tobacco leaves are injected automatically. But the problem is the size of this kind of machine is large. Particularly, the length of this kind of machine has to be more two times of the length of a cigarette. For example, such automatic machine generally has a chamber to contain tobaccos which will be injected into the cigarette paper tube. In order to fulfill the cigarette paper tube, the volume of the chamber is the same or little larger than the cigarette paper tube, and the length of the chamber is the same or a little longer than the length of the cigarette paper tube. At one end of the chamber is a nozzle which is inserted into one open end of the cigarette paper tube. At the other end of the chamber is a piston to inject the tobaccos inside the chamber into the paper tube through the nozzle. The piston is driven by a driving shaft, for example, as worm shaft. Because the piston will slide through the chamber from one end to another to push the tobacco leaves into the cigarette paper tube, the driving shaft at least has to be the same length as the length of the chamber. When the tobacco leaves are loaded into the chamber, the driving shaft has to stay outside the chamber and align with the chamber longitudinally. Considering the driving mechanism, the total length of this machine must be longer than the length of the driving shaft plus the length of the chamber which is at least two times of the length of a cigarette.

Another type of automatic machine incorporates with a spiral nozzle for delivering the tobacco leaves into the cigarette paper tube. However, when the spiral nozzle is rotated for delivering the tobacco leaves, the tobacco leaves will be shredded into small pieces within the cigarette paper tube. Therefore, when the cigarette is lightened, the cigarette ash cannot be held properly while smoking. It is a hassle for the smoker to hold the cigarette steadily to prevent the cigarette ash from falling everywhere. In other words, if the cigarette ash can be held properly by not shredding the cigarette leaves in the cigarette paper tube, the smoker can easily and precisely flick the cigarette ash in the ashtray.

Another cigarette making machine, such as U.S. Pat. No. 4,167,948, disclosed a pocket-sized machine for making cigarettes. The cigarette making machine generally comprises a casing defining a chamber at the front side, and an operating handle pivotally coupled at the rear side of the casing, wherein the operating handle is pivotally moved to the right side of the casing in order to drive a tobacco compacting member from an open position to a closed position for compressing the tobacco in the chamber.

Accordingly, the user must manually apply the pushing force at the operating handle to drive the tobacco compacting member to its closed position. The manual operation of the operating handle is safer than an automatic operation of the tobacco compacting member which is powered by a motor. The automatic operated cigarette making machine is that the user is able to press a button to activate the motor to drive the tobacco compacting member. If the button is accidentally pressed at the time when the tobacco leaves are fed into the chamber by the fingers of the user, the fingers of the user may be cut by the sharp edge of the tobacco compacting member.

However, this cigarette making machine has several drawbacks. Since the operating handle is pivotally linked at the rear side of the casing, the user must pivotally push the operating handle toward the first side of the casing in order to move the tobacco compacting member to its closed position. In other words, the user must securely hold the casing stably to withstand the pushing force at the operating handle. If the casing is not held stably, the pushing force at the operating handle will transmit to the casing so as to push the casing forward. As a result, the tobacco compacting member cannot be smoothly and completely moved to its closed position for evenly compressing the tobacco in the chamber.

Furthermore, the operating handle is connected to the tobacco compacting member via a single link member which has an elongated structure, wherein one end of the single link member is rotatably coupled at the operating handle while an opposed end of the single link member is rotatably coupled at a mid-portion of the tobacco compacting member. Therefore, by pivotally moving the operating handle, the single link member transmits the pivot movement of the operating handle to the linear movement of the tobacco compacting member. Since the pushing force is only exerted at the mid-portion of the tobacco compacting member, the tobacco compacting member cannot be linearly moved in a balanced manner. As a result, the tobacco compacting member cannot evenly compress the tobacco in the chamber, such that the quality of the cigarette made by the cigarette making machine cannot be guaranteed. Furthermore, since the user must apply a relatively large force to drive the tobacco compacting member in order to compress the tobacco, the single link member must be rigid enough to transmit the force from the operating handle to the tobacco compacting member. Once the single link member is broken, the cigarette making machine will be abandoned.

Another drawback of the cigarette making machine is that a spring extends between the side of the casing and the operating handle such that the operating handle is pivoted against the action of spring to the closed position. In other words, at the open position, the spring will pull the operating handle toward the closed position. As a result, the concave leading edge of the tobacco compacting member is moved toward the chamber at the open position of the operating handle. Therefore, the size of the chamber cannot be maximized while the elongated aperture is covered by the concave leading edge of the tobacco compacting member. In other words, the user cannot fully utilize the chamber to fill the tobacco in the chamber through the elongated aperture. In addition, the concave leading edge of the tobacco compacting member is exposed within the elongated aperture, such that the concave leading edge of the tobacco compacting member may cut the finger of the user when the tobacco is filled and pressed into the chamber through the elongated aperture by the fingers of the user.

Another drawback of the cigarette making machine is that the cigarette making machine provides a tube retaining lever to retain the paper tube on the nipple during injection. During the injection, the tobacco in the chamber is pushed by the spoon in order to inject into the paper tube. If the tube cannot be held securely at the nipple, the paper tube will be pushed out of the nipple when injecting the tobacco. Therefore, the tip of the tube retaining lever can press against the nipple to hold the paper tube thereat during injection. However, the cigarette making machine did not provide any releasing mechanism to release the paper tube when the injection process is completed. In other words, at the time when almost all the tobaccos in the chamber are pushed and injected into the paper tube, the paper tube is kept holding at the nipple by the tube retaining lever. As a result, the paper tube may be torn off by the tube retaining lever by the injecting force when the tobacco is completely injected into the paper tube. A lack of release mechanism results in the maker giving it a weak hold on the tube to reduce the chances of tearing the tube. However, a weaker hold increases the chances of the tube not being filled properly.

SUMMARY OF THE PRESENT INVENTION

The invention is advantageous in that it provides a cigarette tube injector, which has a pocket size to form an ultra compact size for enhancing the portability of the cigarette tube injector.

Another advantage of the invention is to a cigarette tube injector, which can pack the tobacco leaves within the hollow cigarette paper tube with a uniform and proper compactness.

Another advantage of the invention is to a cigarette tube injector, which is operated manually without involving any electrical component to prevent any electrical malfunction thereof.

Another advantage of the invention is to a cigarette tube injector, which can load the tobacco leaves within the hollow cigarette paper tube without shredding the tobacco leaves.

Another advantage of the invention is to a cigarette tube injector, wherein during the injecting operation of the tobacco leaves into the cigarette paper tube, the cutting edge of the feeding pusher is hidden for safety purpose while the top opening is enclosed for ensuring all the tobacco leaves in the tobacco cavity to be fed into the cigarette paper tube.

Another advantage of the invention is to a cigarette tube injector, wherein the cigarette paper tube is automatically retained at the tubular holder by the sliding movement of the feeding pusher and is automatically released right after the tobacco leaves are fed into the cigarette paper tube.

Another advantage of the invention is to a cigarette tube injector, which can make a tight and even injection to have a better quality of cigarettes.

Another advantage of the invention is to a cigarette tube injector, which compresses the tobacco leaves before injection.

Additional advantages and features of the invention will become apparent from the description which follows, and may be realized by means of the instrumentalities and combinations particular point out in the appended claims.

According to the present invention, the foregoing and other objects and advantages are attained by a cigarette tube injector for injecting tobacco leaves into a hollow cigarette paper tube, comprising a pocket casing and a cigarette filling arrangement.

The pocket casing has a tobacco cavity which defines a top opening on a top side of the pocket casing for disposing the tobacco leaves at the tobacco cavity, and a feeding opening for the cigarette paper tube alignedly supporting thereat, wherein the feeding opening is formed at a longitudinal direction of the pocket casing as an injection direction.

The cigarette filling arrangement comprises a feeding pusher slidably supported at the pocket casing to move along a transverse direction thereof which is perpendicular to the injection direction for pushing the tobacco leaves at the tobacco cavity, and a slide spoon slidably coupled at the pocket casing at the injection direction to align with the feeding opening, wherein the feeding pusher is moved toward the slide spoon for pushing the tobacco leaves to the slide spoon, such that the slide spoon is slid for feeding the tobacco leaves at the tobacco cavity into the cigarette paper tube through the feeding opening.

In accordance with another aspect of the invention, the present invention comprises a method of injecting tobacco leaves into a hollow cigarette paper tube by a cigarette tube injector which comprises a pocket casing, a feeding pusher and a slide spoon, wherein the method comprises the following steps.

(A) Dispose the tobacco leaves at a tobacco cavity of the pocket casing through a top opening thereof, wherein the top opening is formed on a top side of the pocket casing.

(B) Move the feeding pusher along a transverse direction of the pocket casing for pushing the tobacco leaves at the tobacco cavity toward the slide spoon.

(C) Move the slide spoon at an injection direction, which is perpendicular to the transverse direction, for feeding the tobacco leaves at the tobacco cavity into the cigarette paper tube through a feeding opening of the pocket casing.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1:
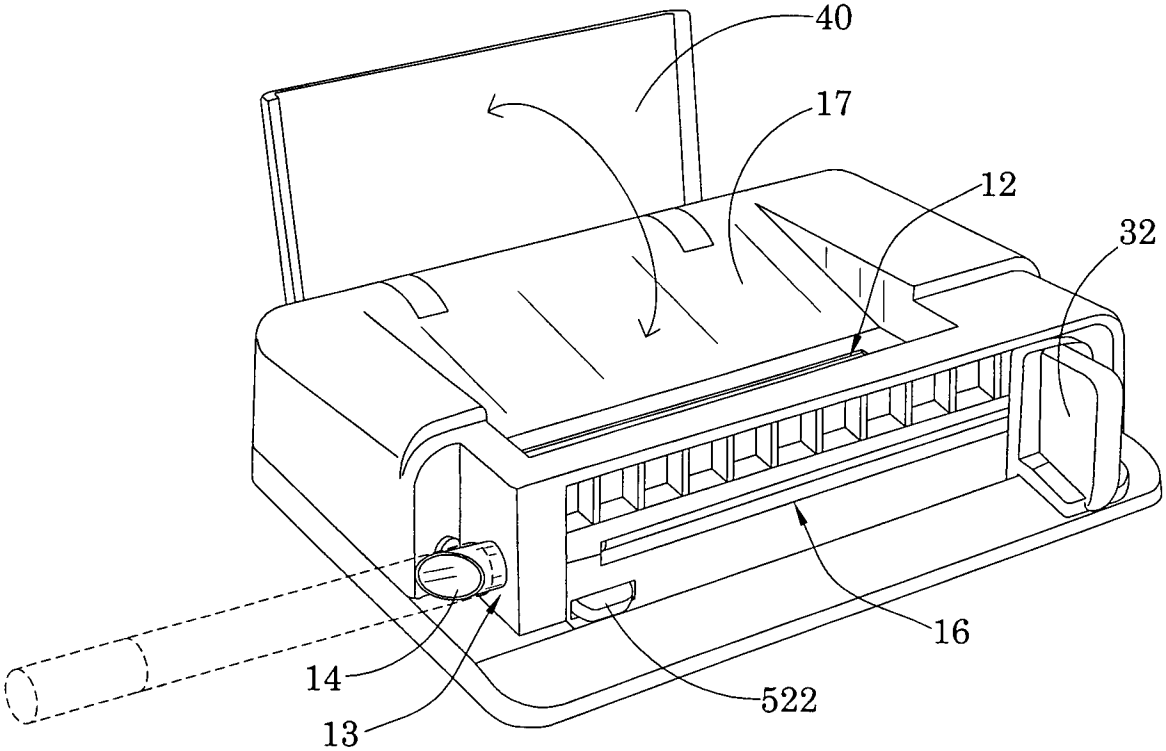
FIG. 1 is a perspective view of a cigarette tube injector according to a preferred embodiment of the present invention, illustrating a pivot movement of the actuation handle.

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Referring to FIGS. 1 to 5, a cigarette tube injector according to a preferred embodiment of the present invention is illustrated, wherein the cigarette tube injector is arranged for injecting tobacco leaves into a hollow cigarette paper tube. The cigarette tube injector comprises a pocket casing 10 and a cigarette filling arrangement.

The pocket casing 10 has a pocket size with a dimension that the length is lesser 13.5 cm, the width is lesser 10.5 cm, and the height is lesser 3.5 cm. The pocket casing 10, which can be fitted into a pocket, forms an ultra compact size for enhancing the portability of the cigarette tube injector. The pocket casing 10 has a tobacco cavity 11 which defines a top opening 12 on a top side of the pocket casing 10 for disposing the tobacco leaves at the tobacco cavity 11 through the top opening 12. Accordingly, the top opening 12 is an elongated through opening longitudinally formed on the top side of the pocket casing 10, wherein the top opening 12 has first and second longitudinal edges 121, 122 to define a space therebetween to communicate with the tobacco cavity 11.

The pocket casing 10 further has a slanted delivering wall 17 formed on the top side of the pocket casing 10, wherein the delivering wall 17 is inclinedly and downwardly extended to the first longitudinal edge 121 of the top opening 12, such that when the tobacco leaves are disposed on the delivering wall 17, the tobacco leaves are easily pushed into the tobacco cavity 11 through the top opening 12 on the delivering wall 17.

The pocket casing 10 further has a feeding opening 13 formed on a sidewall of the pocket casing 10 for the cigarette paper tube alignedly supporting thereat, wherein the feeding opening 13 is formed at a longitudinal direction of the pocket casing as an injection direction of the tobacco leaves.

The pocket casing 10 further has a tubular holder 14 coaxially extended from the feeding opening 13 at a longitudinal direction of the pocket casing 10, wherein the tubular holder 14 is arranged to slidably insert into an opening of the cigarette paper tube to ensure the feeding opening 13 to be aligned with the cigarette paper tube.

The cigarette filling arrangement comprises a feeding pusher 20 and a slide spoon 30 for pushing and compressing the tobacco leaves and for feeding the tobacco leaves into the cigarette paper tube respectively.

Figure 2:
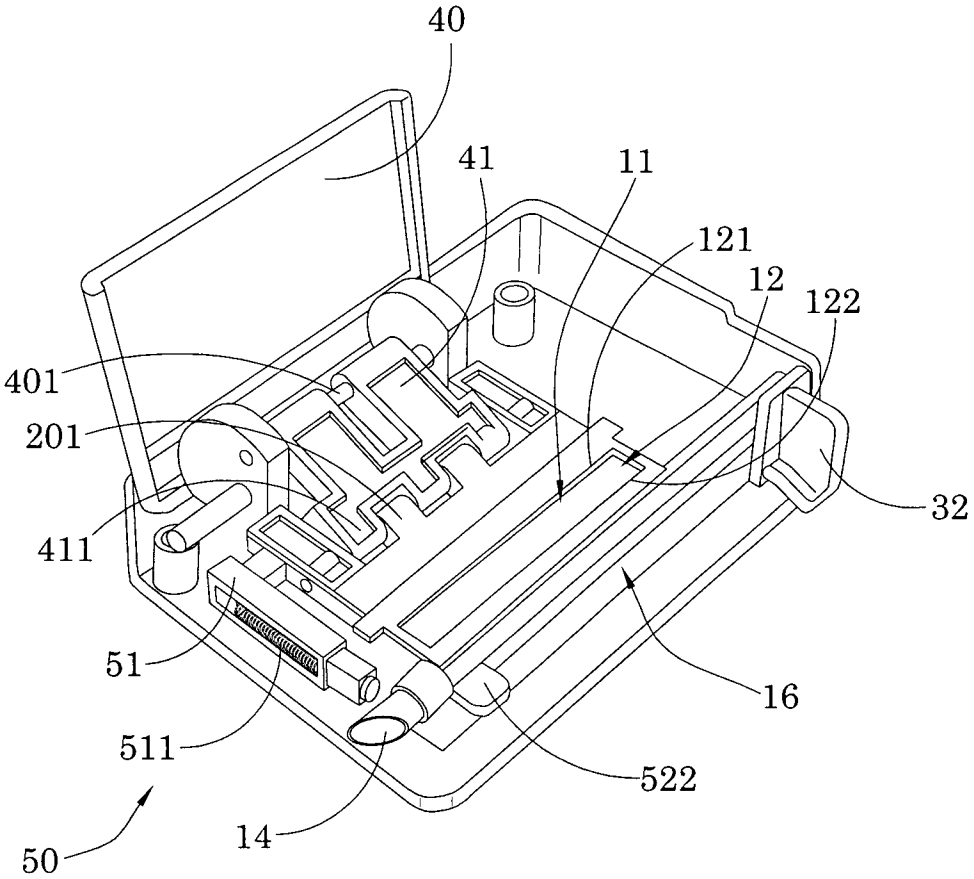
FIG. 2 is a perspective view of the cigarette tube injector according to the above preferred embodiment of the present invention, illustrating the actuation handle at an upright position.

As shown in FIG. 2, the feeding pusher 20 is slidably supported in the pocket casing 10 to move along a transverse direction thereof which is perpendicular to the injection direction for pushing the tobacco leaves at the tobacco cavity 11 toward the slide spoon 30.

Figure 5:
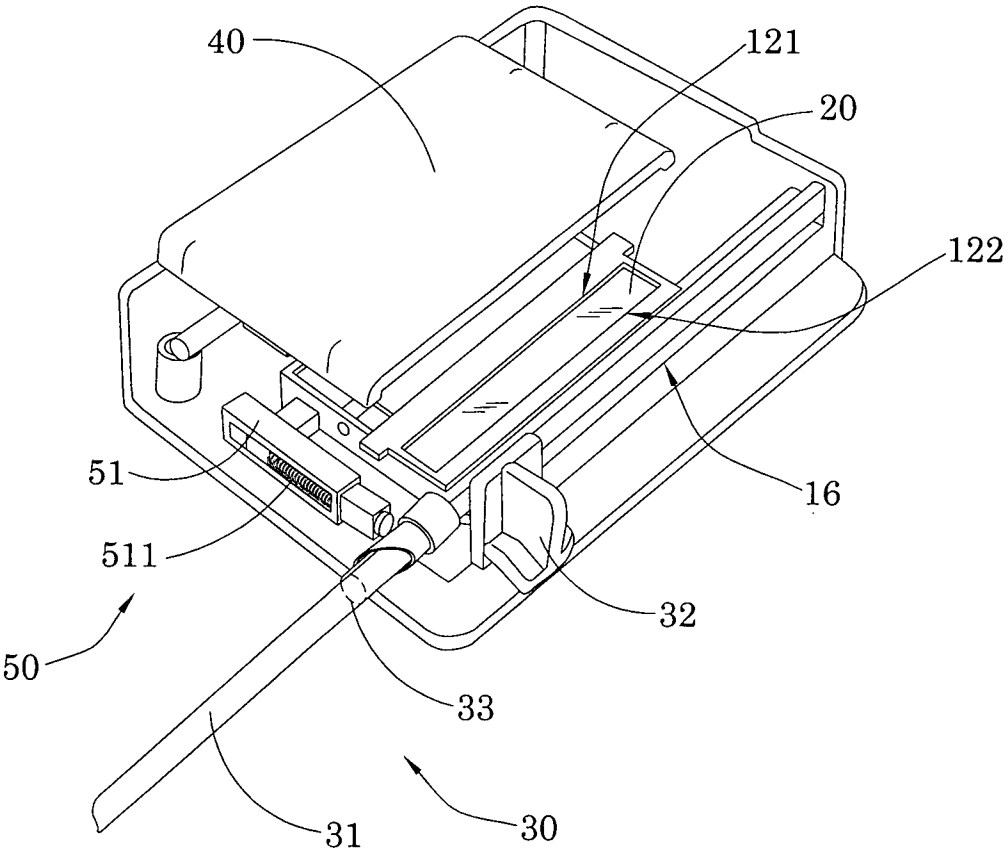
FIG. 5 is a perspective view of the cigarette tube injector according to the above preferred embodiment of the present invention, illustrating the slide spoon being slid out of the feeding opening.

The slide spoon 30 is slidably coupled at the pocket casing 10 at the injection direction to align with the feeding opening 13, wherein when the feeding pusher 20 is moved toward the slide spoon 30 for pushing the tobacco leaves to the slide spoon 30, the slide spoon 30 is slid for feeding the tobacco leaves at the tobacco cavity into the cigarette paper tube through the feeding opening 13, as shown in FIG. 5.

As shown in FIG. 2, the pocket casing 10 further has a longitudinal spoon sliding channel 15 longitudinally formed at a front portion of the pocket casing 10 and a longitudinal spoon guiding slot 16 longitudinally formed at a front wall of the pocket casing 10 to communicate with the spoon sliding channel 15. Accordingly, the slide spoon 30 is slidably received at the spoon sliding channel 15 to guide the sliding movement of the slide spoon 30.

The slide spoon 30 comprises a curved spooning sidewall 31 extended longitudinally to align with the feeding opening 13 and slidably received at the spoon sliding channel 15, and a pusher handle 32 outwardly extended from the curved spooning sidewall 31, wherein the pusher handle 32 is extended out of the front wall of the pocket casing 10 through the spoon guiding slot 16. Therefore, when the pusher handle 32 is slid along the spoon guiding slot 16, the curved spooning sidewall 31 is guided to slide along the spoon sliding channel 15.

Figure 6:
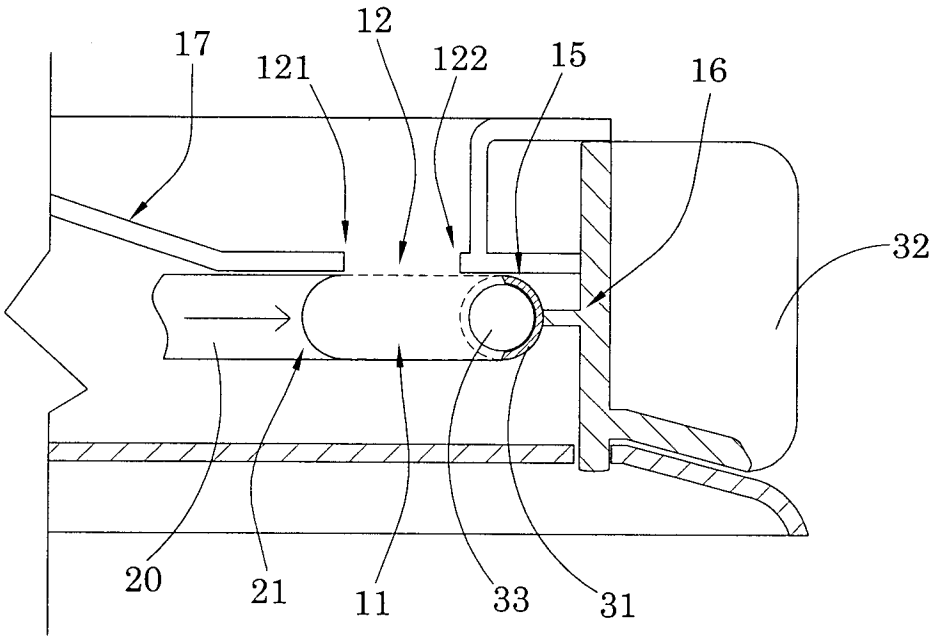
FIG. 6 is a side sectional view of the cigarette tube injector according to the above preferred embodiment of the present invention, illustrating the tobacco cavity formed between the curved spooning sidewall and the curved cutting wall.

According to the preferred embodiment, the feeding pusher 20 has a curved cutting wall 21 defining two sharp edges, wherein the tobacco cavity 11 is defined between the curved cutting wall 21 of the feeding pusher 20 and the curved spooning sidewall 31 of the slide spoon 30, as shown in FIG. 6. When the feeding pusher 20 is pushed toward the slide spoon 30, the curved cutting wall 21 of the feeding pusher 20 is moved for trimming the tobacco leaves within the tobacco cavity 11.

Preferably, a front portion of the feeding pusher 20 is made of metal, such as stainless steel, wherein the cutting wall 21 is formed at the front portion of the feeding pusher 20. In other words, the tobacco leaves will be trimmed by the sharp edges of the cutting wall 21 to prevent the tobacco leaves being stuck or jammed at the edge of the tobacco cavity 11. It is worth mentioning that if the cutting wall 21 is made of plastic, the edges of the cutting wall 21 will not be sharp enough to trim the tobacco leaves. As a result, when the feeding pusher 20 is pushed toward the slide spoon 30, the tobacco leaves may be stuck between the edge of the cutting wall 21 and the first longitudinal edge 121 of the top opening 12.

In particular, when the feeding pusher 20 is pushed toward the slide spoon 30, the curved cutting wall 21 of the feeding pusher 20 is aligned with the curved spooning sidewall 31 of the slide spoon 30 edge-to-edge to minimize a size of the tobacco cavity 11 and to form a compressing chamber for retaining the tobacco leaves thereat. Preferably, each of the curved cutting wall 21 of the feeding pusher 20 and the curved spooning sidewall 31 of the slide spoon 30 has a semi-circular shape such that when the curved cutting wall 21 of the feeding pusher 20 is aligned with the curved spooning sidewall 31 of the slide spoon 30, the compressing chamber having a circular shape is formed. Accordingly, the circumferential size of the compressing chamber is corresponding to that of the cigarette paper tube. Preferably, the circumferential size of the compressing chamber is slightly smaller than that of the cigarette paper tube. In other words, the tobacco leaves in the compressing chamber will fit into the cigarette paper tube.

The slide spoon 30 further comprises a loading pusher 33 supported at the curved spooning sidewall 31 within the compressing chamber, wherein the loading pusher 33 has a flat pushing surface facing toward the feeding opening 12. Accordingly, after the curved cutting wall 21 of the feeding pusher 20 is coupled with the curved spooning sidewall 31 of the slide spoon 30 for compressing the tobacco leaves within the compressing chamber, the curved spooning sidewall 31 is slidably pushed out of the feeding opening 13 by the pusher handle 32. At the same time, the loading pusher 33 is driven toward the feeding opening 13 for feeding the tobacco leaves from the compressing chamber into the cigarette paper tube.

According to the preferred embodiment, the top opening 12 of the pocket casing 10 can be opened or closed by the feeding pusher 20. When the feeding pusher 20 is slid away from the curved spooning sidewall 31 of the slide spoon 30, the curved cutting wall 21 of the feeding pusher 20 is moved behind the first longitudinal edge 121 of the top opening 12. Therefore, the top opening 12 is fully exposed and opened for the tobacco leaves disposing into the tobacco cavity 11.

When the curved cutting wall 21 of the feeding pusher 21 is moved to engage with the curved spooning sidewall 31 of the slide spoon 30 to form the compressing chamber, the curved cutting wall 21 of the feeding pusher 20 is moved across the second longitudinal edge 122 of the top opening 12. Therefore, the curved cutting wall 21 of the feeding pusher 20 is hidden from the top opening 12 while the top opening 12 is also enclosed by the feeding pusher 21. It is worth mentioning that the sharp edges at the curved cutting wall 21 of the feeding pusher 20 are hidden for safety purpose. In addition, when the compressing chamber is formed, the tobacco leaves in the compressing chamber is ready to feed into the cigarette paper tube. Therefore, the top opening 12 is enclosed for ensuring all the tobacco leaves in the compressing chamber can be fed into the cigarette paper tube.

In particular, the cigarette filling arrangement further comprises an actuation handle 40 pivotally coupled at the top side of the pocket casing 10 to drive a sliding movement of the feeding pusher 20.

As shown in FIG. 2, when the actuation handle 40 is pivotally and upwardly moved from the top side of the pocket casing 10, i.e. the upright position of the actuation handle 40, the feeding pusher 20 is driven to slide away from the slide spoon 30. In particular, at the upright position of the actuation handle 40, the curved cutting wall 21 of the feeding pusher 20 is moved behind the first longitudinal edge 121 of the top opening 12 so as to open up the top opening 12. According to the preferred embodiment, the actuation handle 40 not only functions as an operation handle to drive the movement of the feeding pusher 20 but also functions as a casing cover to cover on the top side of the pocket casing 10.

Figure 4:
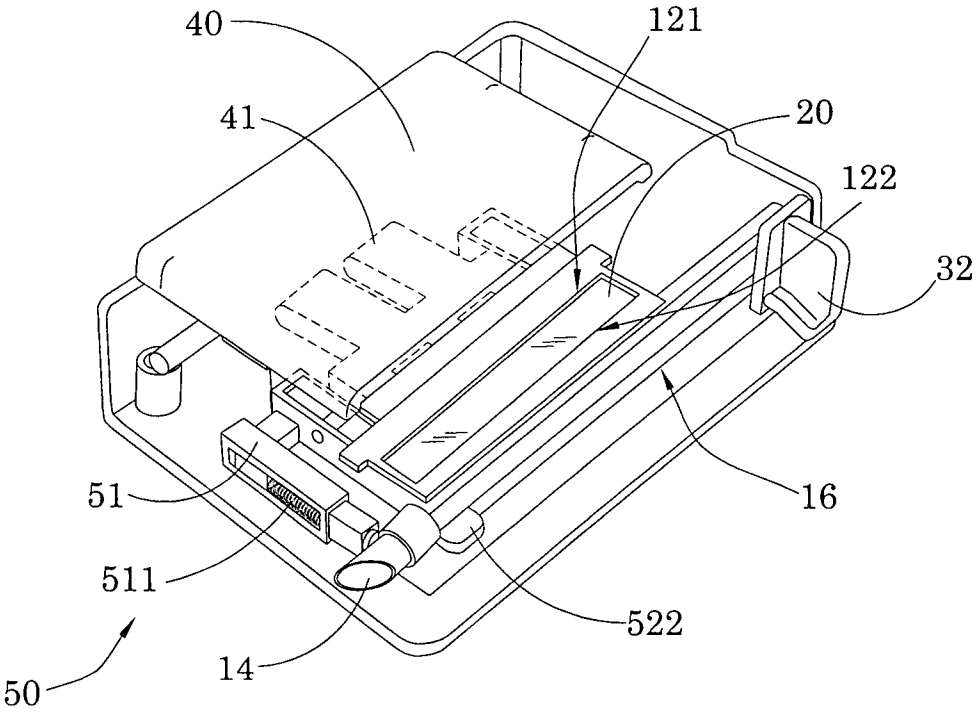
FIG. 4 is a perspective view of the cigarette tube injector according to the above preferred embodiment of the present invention, illustrating the actuation handle being folded on the pocket casing to form the compressing chamber.

As shown in FIG. 4, when the actuation handle 40 is pivotally and downwardly moved to cover on the top side of the pocket casing 10, i.e. the covering position of the actuation handle 40, the feeding pusher 20 is driven to slide toward the slide spoon 30 for pushing the tobacco leaves. In particular, at the covering position of the actuation handle 40, the curved cutting wall 21 of the feeding pusher 20 is moved across the second longitudinal edge 122 of the top opening 12 to close the top opening 12. It is worth mentioning that when the actuation handle 40 is pivotally and downwardly moved to cover on the top side of the pocket casing 10, the cigarette tube injector is formed at a storage position for minimizing the overall size thereof. Accordingly, the actuation handle 40 is pivotally and downwardly moved to cover the delivering wall 17 on the top side of the pocket casing 10. In other words, the covering position of the actuation handle 40 is the storage position of the cigarette tube injector. The only difference between the covering position of the actuation handle 40 and the storage position of the cigarette tube injector is that the tobacco leaves are disposed in the tobacco cavity 11 at the covering position of the actuation handle 40 while there is no tobacco leave in the tobacco cavity 11 at the storage position of the cigarette tube injector.

It is worth mentioning that the user will apply a downward pushing force to pivotally fold the actuation handle 40 to its covering position. The downward pushing force will also ensure the pocket casing 10 to be stably retained on the surface. In other words, the folding operation of the actuation handle 40 will not accidentally move the pocket casing 10. In fact, the folding operating of the actuation handle 40 will enhance the stabilization of the pocket casing 10 on the surface.

Figure 3:
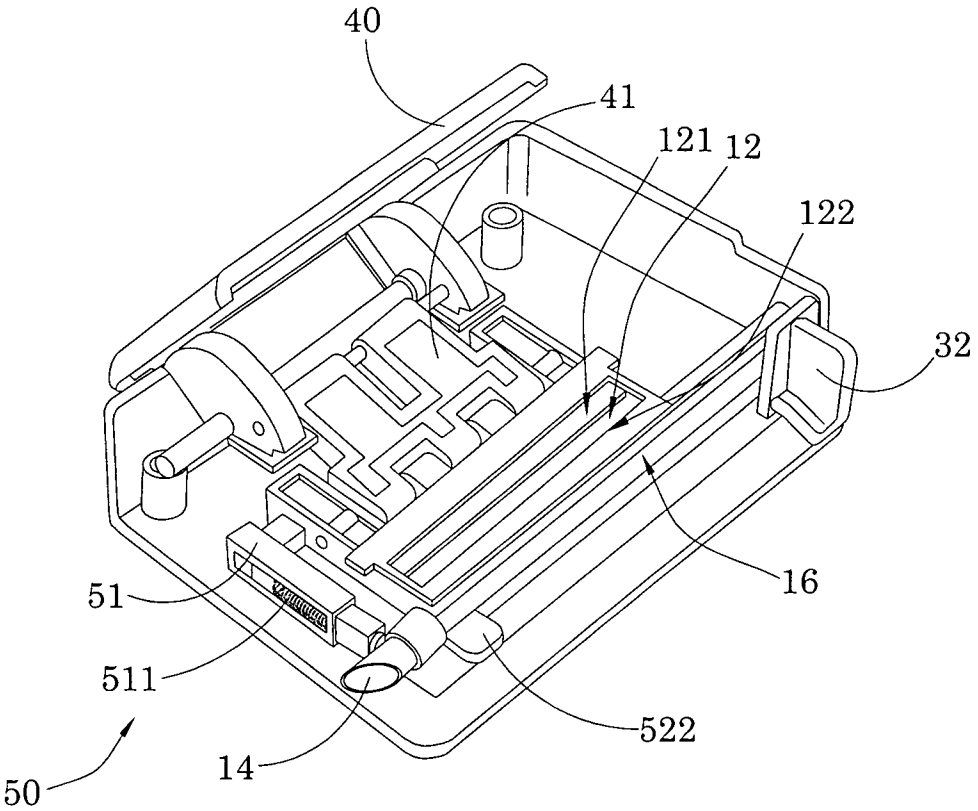
FIG. 3 is a perspective view of the cigarette tube injector according to the above preferred embodiment of the present invention, illustrating the actuation handle folding on the pocket casing to push the feeding pusher toward the slide spoon.

As shown in FIGS. 2 to 4, the actuation handle 40 is operatively linked to the feeding pusher 20 via a transmission member 41. Accordingly, two opposed edges, i.e. the rear edge and the front edge, of the transmission member 41 are pivotally coupled with the actuation handle 40 and the feeding pusher 20 respectively.

The rear edge of the transmission member 41 is rotatably coupled at an actuation axle 401 of the actuation handle 40, wherein when the actuation handle 40 is pivotally and downwardly moved to the top side of the pocket casing 10, the transmission member 41 is pushed forward. The transmission member 41 has a plurality of transmission arms 411 spacedly and frontwardly extended from the front edge of the transmission member 41. The feeding pusher 20 has a plurality of coupling arms 201 rearwardly extended from the rear edge of the feeding pusher 20, wherein the transmission arms 41 are rotatably coupled with the coupling arms 201 to rotatably couple the transmission member 41 with the feeding pusher 20. As shown in FIG. 2, there are three transmission arms 411 spacedly and frontwardly extended from the front edge of the transmission member 41 and there are two coupling arms 201 rearwardly extended from the rear edge of the feeding pusher 20. The three transmission arms 411 are alternating with the two coupling arms 201. Therefore, when the actuation handle 40 is pivotally and downwardly moved to the top side of the pocket casing 10, the transmission member 41 will be pushed evenly by the actuation handle 40 and will be moved forward in a linear manner. As a result, the feeding pusher 20 will be pushed by the transmission member 41 to move forward in a linear manner. It is worth mentioning that through the engagement between the transmission arms 411 and the coupling arms 201, the pushing force will be evenly applied along the rear edge of the feeding pusher 20. Therefore, the tobacco leaves can be evenly compressed by the feeding pusher 20 in the tobacco cavity 11. In other words, the compactness of the tobacco will be even in the compressing chamber.

Figure 8:
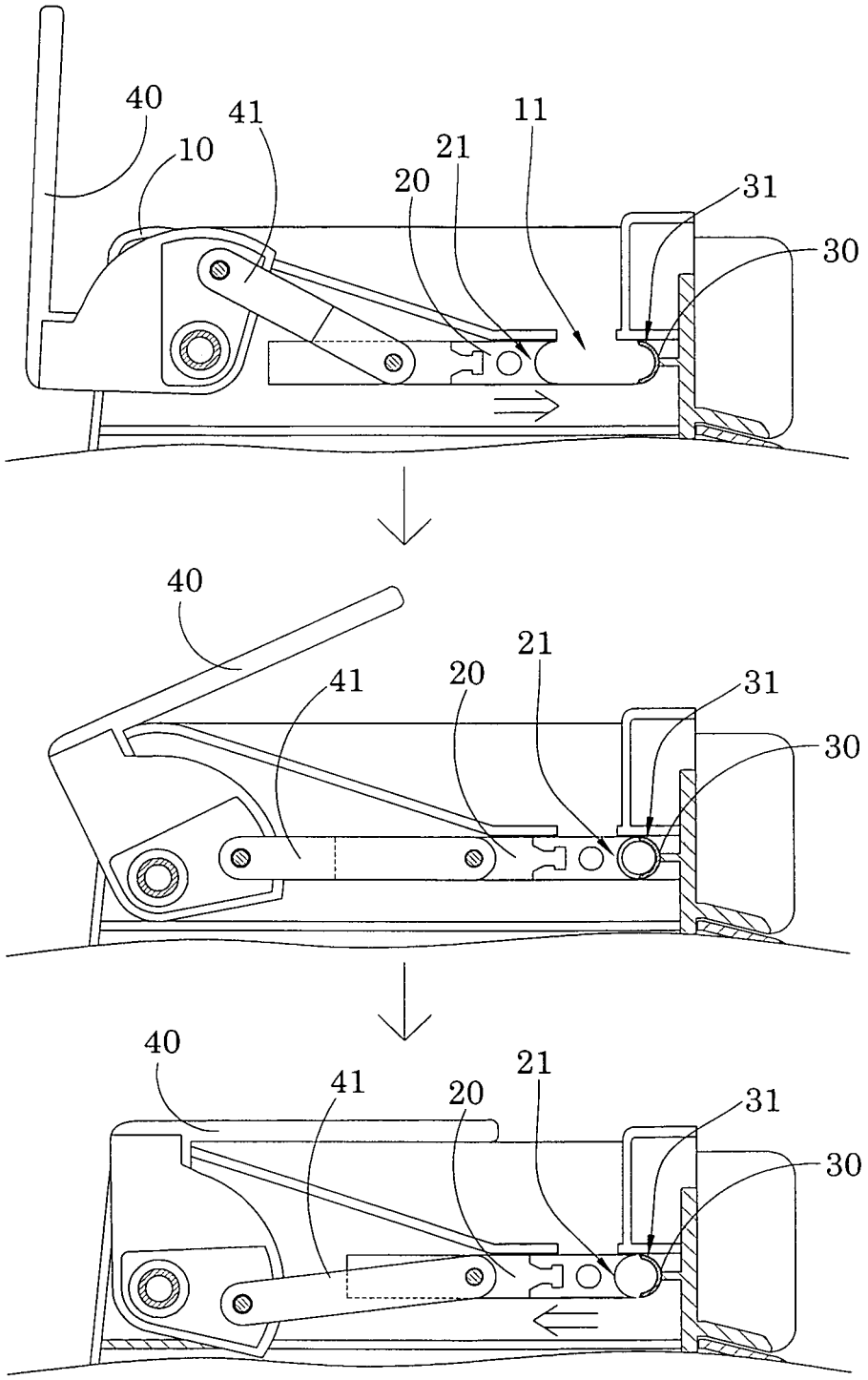
FIG. 8 illustrates the movements of the transmission member of the cigarette tube injector when the actuation handle is pivotally folded between the upright position to the covering position according to the above preferred embodiment of the present invention.

As shown in FIG. 8, when the actuation handle 40 is pivotally and upwardly moved from the top side of the pocket casing 10, i.e. the upright position, the transmission member 41 is supported in a first inclined orientation. In other words, the transmission member 41 is inclined at a position that the rear edge of the transmission member 41 is located above the front edge thereof. It is worth mentioning that the actuation handle 40 is pivotally folded to its upright position when the actuation handle 40 is pivotally moved at the rear side of the pocket casing 10.

When the actuation handle 40 is pivotally and downwardly moved before covering on the top side of the pocket casing 10, i.e. toward the covering position, the transmission member 41 is shifted from the first inclined orientation to a horizontal orientation so as to push the feeding pusher 20 to the slide spoon 30. Accordingly, the actuation handle 40 is pivotally folded at its transitional position which is between the upright position and the covering position. At this point, the compressing chamber is formed that the tobacco leaves are compressed by the cutting wall 21 of the feeding pusher 20 to the spooning sidewall 31 of the slide spoon 30. In other words, at the transitional position of the actuation handle 40, the tobacco leaves are compressed between the feeding pusher 20 and the slide spoon 30 in maximized within the compressing chamber. Preferably, the actuation handle 40 is pivotally folded to ¾ of the totally traveling distance, i.e. from the upright position to the covering portion, in order to compress the tobacco leaves.

When the actuation handle 40 is pivotally and downwardly moved to cover on the top side of the pocket casing 10, i.e. the covering position, the transmission member 41 is shifted from the horizontal orientation to a second inclined orientation so as to pull the feeding pusher 20 away from the slide spoon 30. The second inclined orientation of the transmission member 41 is that the rear edge of the transmission member 41 is located below the front edge thereof. Once the tobacco leaves are compressed, the feeding pusher 20 is slightly pulled backward to allow the actuation of the slide spoon 30 to inject the compressed tobacco leaves into the cigarette paper tube easily. It is worth mentioning that the circumferential size of the compressing chamber is slightly smaller than that of the cigarette paper tube. Therefore, the circumferential size of the compressed tobacco leaves is slightly smaller than that of the cigarette paper tube, such that the compressed tobacco leaves can be smoothly injected into the cigarette paper tube.

Accordingly, the transmission member 41 is arranged to transmit the rotational movement of the actuation handle 40 to the linear sliding movement of the feeding pusher 20. The orientation shifting configuration of the transmission member 41 will also minimize the space of the pocket casing 10 for the transmission member 41 for shifting the angular force from the actuation handle 40 to the linear force for the feeding pusher 20. Furthermore, the rear edge of the feeding pusher 20 is pivotally coupled with the front edge of the transmission member 41. Therefore, when the transmission member 41 is moved forward, the rear edge of the feeding pusher 20 is pushed forward as well. In other words, the pushing force from the transmission member 41 will exert at the feeding pusher 20 to evenly and stably push the cutting wall 21 of the feeding pusher 20 to the spooning sidewall 31 of the slide spoon 30. As a result, the transmission member 41 will ensure the linear movement of the feeding pusher 20 to apply an even compression force to compress the tobacco leaves.

As shown in FIGS. 2 to 4, the pocket casing 10 further comprises a tube retainer 50 transversely extended to bias against the tubular holder 14 by means of spring force for retaining the cigarette paper tube at the tubular holder 14 when the tobacco leaves are fed into the cigarette paper tube.

The tube retainer 50 comprises a spring-loaded pusher arm 51 coupled at the feeding pusher 20 and arranged in such a manner that when the feeding pusher 20 is moved for pushing the tobacco leaves at the tobacco cavity 11, the pusher arm 51 is driven to slide toward the tubular holder 14 at a position that a pushing end of the pusher arm 51 is biased against the tubular holder 14.

Accordingly, the pusher arm 51 comprises a compression spring 511 coupled with the feeding pusher 20 for applying the spring force at the pushing end of the pusher arm 51 to bias against the tubular holder 14. Therefore, when the feeding pusher 20 is moved toward the slide spoon 30, the pusher arm 51 is driven to push until the pushing end of the pusher arm 51 is biased against the tubular holder 14. The feeding pusher 20 has an extension arm extended to couple with the compression spring 511 in order to link to the pusher arm 51.

In particular, before the curved cutting wall 21 of the feeding pusher 21 is moved to engage with the curved spooning sidewall 31 of the slide spoon 30 to form the compressing chamber, i.e. before the covering position of the actuation handle 40, the pushing end of the pusher arm 51 is already contacted with the tubular holder 14. Therefore, the cigarette paper tube is held at the tubular holder 14 by the pushing end of the pusher arm 51. Once the actuation handle 40 is fully folded to the covering position to engage the curved cutting wall 21 of the feeding pusher 21 with the curved spooning sidewall 31 of the slide spoon 30, the compression spring 511 is compressed for applying the spring force at the pushing end of the pusher arm 51 to ensure the pushing end of the pusher arm 51 to be kept contacting with the tubular holder 14. It is worth mentioning that the spring force at the pushing end of the pusher arm 51 will ensure the cigarette paper tube to be securely retained at the tubular holder 14 especially when the slide spoon 30 is slid to feed the tobacco leaves into the cigarette paper tube, as shown in FIG. 5. In other words, the spring force is greater than the feeding force at the slide spoon 30.

It is worth mentioning that the compression spring 511 is coupled between the pusher arm 51 and the feeding pusher 20. The compression spring 511 will not apply any spring force against the pocket casing 10. In particular, the pusher arm 51 is moved by the actuation handle 40. When the actuation handle 40 is pivotally moved at its upright position, the pusher arm 51 is moved toward the tubular holder 14 while the compression spring 511 does not generate any spring force. When the actuation handle 40 is pivotally moved from its upright position to its transitional position, the pusher 51 is moved toward until the pushing end of the pusher arm 51 contacts with the tubular holder 14. Once the pushing end of the pusher arm 51 contacts with the tubular holder 14, the compression spring 511 will start to be compressed for generating the spring force. When the actuation handle 40 is pivotally moved from its covering position, the compression spring is still compressed for generating the spring force to ensure the pushing end of the pusher arm 51 to be kept contacting with the tubular holder 14.

Accordingly, there is not spring force generated by the compression spring 511 when the actuation handle 40 is pivotally moved at its upright position. In other words, at the upright position of the handle 40, the curved cutting wall 21 of the feeding pusher 20 is moved behind the first longitudinal edge 121 of the top opening 12. It is important that the actuation handle 40 will not be pulled by the spring force at the upright position. Accordingly, when the actuation handle 40 is pivotally moved at its upright position, the feeding pusher 21 is moved apart from the slide spoon 30 that the feeding pusher 21 is free of spring force at this position. Therefore, the top opening 12 will be fully exposed and opened for the tobacco leaves disposing into the tobacco cavity 11. Unlike the conventional cigarette making machine, the spring is coupled between the operating handle and the casing, such that the operating handle is always pulled by the spring from its "open" position to its "closed position. The opening cannot be fully opened at any position of the operating handle. Therefore, the conventional cigarette making machine must incorporate with a locking mechanism to lock up the operating handle at the "open" position. In view of the present invention, the cigarette tube injector will not require any locking mechanism to lock up the actuation handle 40 at its upright position because there is no spring force against the actuation handle 40 at its upright position.

Figure 7:
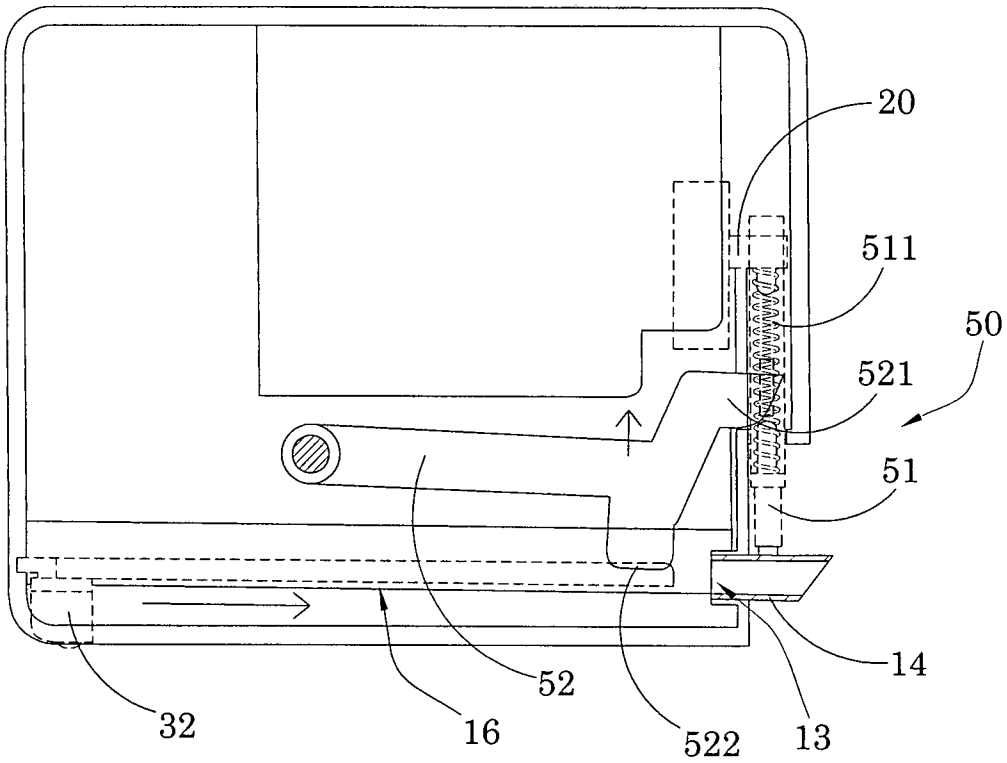
FIG. 7 is a sectional view of the tube retainer according of the cigarette tube injector according to the above preferred embodiment of the present invention.

In order to release the cigarette paper tube from the tubular holder 14 after the tobacco leaves are fed into the cigarette paper tube, the tube retainer 50 further comprises a releasable unit for releasing an engagement between the pushing end of the pusher arm and the tubular holder 14. As shown in FIG. 7, the releasable unit comprises a pivot arm 52 having a pivot end pivotally coupled at the bottom of the pocket casing 10. The pivot arm 52 further having a driving portion 521 engaged with the pusher arm 51 and an actuating portion 522 extended out of the front wall of the pocket casing 10. Accordingly, after the slide spoon 30 is slid for feeding the tobacco leaves into the cigarette paper tube, the actuating portion 522 of the pivot arm 52 is pushed by the slide spoon 30, such that the driving portion 521 of the pivot arm 52 is moved to drive the pusher arm 51 to move away from the tubular holder 14 for releasing the cigarette paper tube at the tubular holder 14.

Figure 7A:
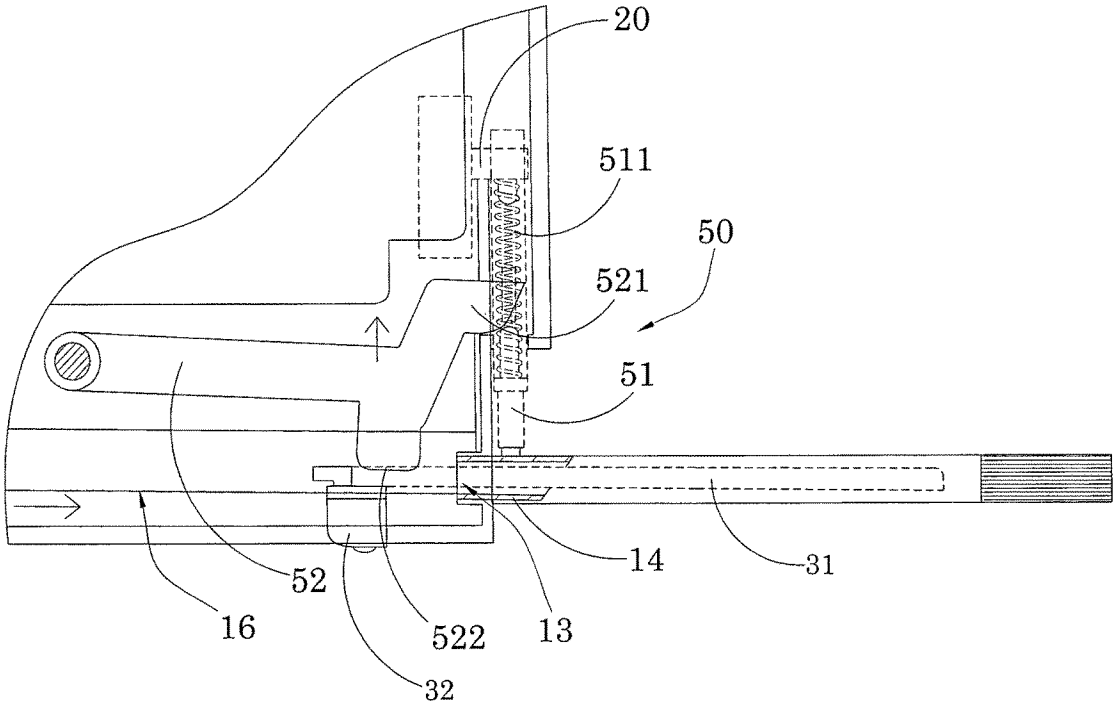
FIGS. 7A and 7B illustrates a pivot movement of the pivot arm to actuate the pusher arm according to the above preferred embodiment of the present invention.
Figure 7B:
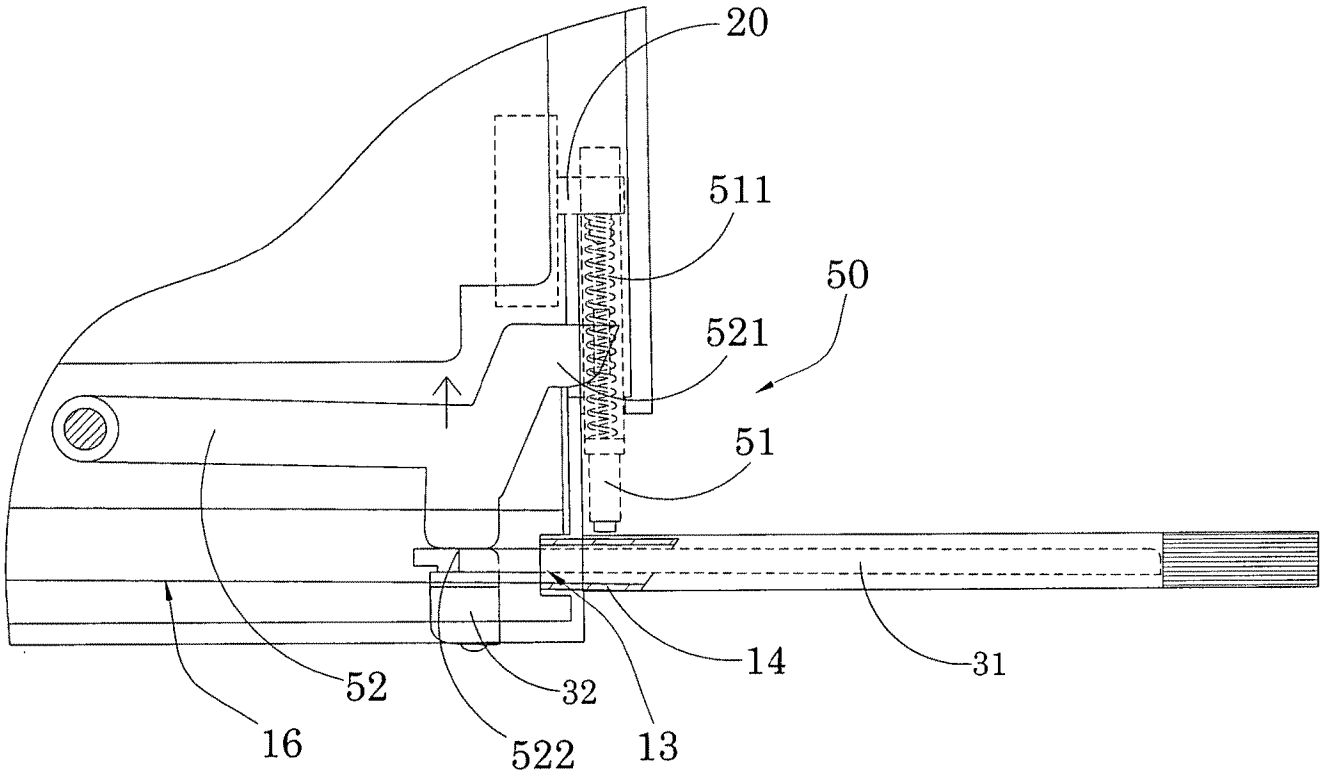

In particular, the actuating portion 522 of the pivot arm 52 is located at an end portion of the spoon guiding slot 16 close to the feeding opening 13. When the slide spoon 30 is slid for feeding the tobacco leaves into the cigarette paper tube, the pusher handle 32 is slid at the spoon guiding slot 16 to contact with the actuating portion 522 of the pivot arm 52, as shown in FIG. 7A. When the actuating portion 522 of the pivot arm 52 is pushed backwardly by the pusher handle 32, the driving portion 521 of the pivot arm 52 is pivotally moved backward, as shown in FIG. 7B, so as to push the pusher arm 51 backward for releasing the cigarette paper tube at the tubular holder 14.

It is worth mentioning that at the time when the pusher handle 32 is slid to contact with the actuating portion 522 of the pivot arm 52, all the tobacco leaves in the compressing chamber are already fed into the cigarette paper tube. However, the pusher handle 32 of the slide spoon 30 is still able to slide from the actuating portion 522 of the pivot arm 52 to the end of the spoon guiding slot 16. After the slide spoon 30 is slid to contact with the actuating portion 522 of the pivot arm 52, as shown in FIGS. 7A and 7B, the pusher arm 51 is moved away from the tubular holder 14 in a backward direction to release the engagement between the pushing end of the pusher arm 51 and the tubular holder 14. Then, the pusher handle 32 of the slide spoon 30 is slid further to the end of the spoon guiding slot 16 for pushing the cigarette paper tube with the tobacco leaves out of the tubular holder 14, so as to unload the cigarette paper tube with the tobacco leaves. It is worth mentioning that if the cigarette paper tube cannot be securely retained at the tubular holder 14, the cigarette paper tube will be pushed out of the tubular holder 14 during the feeding operation of the tobacco leaves. If the cigarette paper tube cannot be released from the tubular holder 14 at the time the feeding operation is completed, the cigarette paper tube will be broken by the feeding force of the tobacco leaves at the injection direction. Therefore, the pusher arm 51 is moved away from the tubular holder 14 for releasing the cigarette paper tube at the tubular holder 14 once the feeding operation is completed.

It is worth mentioning that the actuating portion 522 of the pivot arm 52 is located between the pivot end of the pivot arm 52 and the driving portion 521 thereof. In other words, the distance between the pivot end of the pivot arm 52 and the actuating portion 522 thereof is shorter than the distance between the pivot end of the pivot arm 52 and the driving portion 521 thereof. According to the law of the lever, the effort at the actuating portion 522 of the pivot arm 52 is easier to move the driving portion 521 of the pivot arm 52 with respect to the pivot end thereof. Therefore, the slide spoon 30 is slid to contact with the actuating portion 522 of the pivot arm 52, the driving portion 521 of the pivot arm 52 can be easily pushed to overcome the spring force of the compression spring 511 in order to move the pusher arm 51 away from the tubular holder 14. As a result, the cigarette paper tube is released at the tubular holder 14.

The present invention further provides a method of injecting tobacco leaves into the cigarette paper tube by the following steps.

(1) Dispose the tobacco leaves at the tobacco cavity 11 of the pocket casing 10 through the top opening 12 thereof. Accordingly, the actuation handle 40 is pivotally and upwardly moved from the top side of the pocket casing 10 to the upright position of the actuation handle 40, such that the feeding pusher 20 is driven to slide away from the slide spoon 30 to open up the top opening 12. Assumed that the cigarette paper tube is held at the tubular holder 14 already.

(2) Manually move the feeding pusher 20 along the transverse direction of the pocket casing 10 for pushing the tobacco leaves at the tobacco cavity 11 toward the slide spoon 30. As shown in FIGS. 3 and 4, the actuation handle 40 is pivotally and downwardly moved from the upright position to the covering position to cover on the top side of the pocket casing 10. The curved cutting wall 21 of the feeding pusher 20 is moved toward the curved spooning sidewall 31 of the slide spoon 30 to push and compress the tobacco leaves in the tobacco cavity 11. At the same time, the size of the tobacco cavity 11 is gradually reduced between the curved cutting wall 21 of the feeding pusher 20 and the curved spooning sidewall 31 of the slide spoon 30.

In the step (2), the actuation handle 40 is pivotally folded from the upright position to the transitional position, and then to the covering position. When the actuation handle 40 is folded at the transitional position, the curved cutting wall 21 of the feeding pusher 20 is moved to align with the curved spooning sidewall 31 of the slide spoon 30. Once the curved cutting wall 21 of the feeding pusher 20 and the curved spooning sidewall 31 of the slide spoon 30 are aligned with each other, the compressing chamber is formed to retain and compress the tobacco leaves therein while the tobacco leaves are trimmed by the curved cutting wall 21 of the feeding pusher 20 within the compressing chamber. At the same time, the top opening 12 is closed by the feeding pusher 20 and the curved cutting wall 21 of the feeding pusher 20 is hidden. At the covering position of the actuation handle 40, the feeding pusher 20 is slightly moved backward to release the compression of the tobacco leaves.

In the step (2), the cigarette paper tube is retained at the tubular holder 14 at the feeding opening 13 by means of the spring force when the feeding pusher 20 is moved for pushing the tobacco leaves at the tobacco cavity 11 toward the slide spoon 30. Accordingly, the pusher arm 51 is driven to move forward by the feeding pusher 20 until the pushing end of the pusher arm 51 is biased against the tubular holder 14 for retaining the cigarette paper tube at the tubular holder 14.

(3) Manually move the slide spoon 30 at the injection direction for feeding the tobacco leaves at the tobacco cavity 11 into the cigarette paper tube through the feeding opening 13 of the pocket casing 10. The pusher handle 32 of the slide spoon 30 is actuated to slide along the spoon guiding slot 16 to drive the curved spooning sidewall 31 to be slid at the spoon sliding channel 15 out of the feeding opening 13. The loading pusher 33 will push the tobacco leaves from the compressing chamber into the cigarette paper tube through the feeding opening 13.

During the step (3), the pusher arm 51 is moved backward. The spring force will be released at the tubular holder 14 for releasing the cigarette paper tube right after the tobacco leaves are fed into the cigarette paper tube at the time the pusher handle 32 is slid at the spoon guiding slot 16 to contact with the actuating portion 522 of the pivot arm 52 and to move the pusher arm 51 away from the tubular holder 14 in a backward direction. As a result, the engagement between the pushing end of the pusher arm and the tubular holder 14 is released. Then, the cigarette paper tube with the tobacco leaves therein out of the tubular holder 13 by further sliding the pusher handle 32 of the slide spoon 30 to the end of the spoon guiding slot 16 to unload the cigarette paper tube with the tobacco leaves.

Accordingly, the cigarette tube injector does not involve any electrical component, such as electric motor, to prevent any electric malfunction of the electrical component. Furthermore, the cigarette tube injector incorporates the actuation handle 40 for providing dual functions of forming an actuating handle to drive the sliding movement of the feeding pusher 20 and forming a case casing to cover on the top side of the pocket casing 10. In addition, the slide spoon 30 is supported at the front portion of the pocket casing 10 that only the loading pusher 33 is protruded out of the front wall of the pocket casing 10. Therefore, the configurations of the actuation handle 40 and the slide spoon 30 will substantially reduce the overall size of the cigarette tube injector size to form an ultra compact size for enhancing the portability of the cigarette tube injector.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A cigarette tube injector for injecting tobacco leaves into a hollow cigarette paper tube, comprising:

a pocket casing having a tobacco cavity which defines a top opening on a top side of said pocket casing for disposing said tobacco leaves at said tobacco cavity, and a feeding opening for said cigarette paper tube alignedly supporting thereat, wherein said feeding opening is formed at a longitudinal direction of said pocket casing as an injection direction, wherein said pocket casing further comprises a tubular holder coaxially extended from said feeding opening for being inserted into an opening of said cigarette paper tube, and a tube retainer transversely extended to bias against said tubular holder by means of spring force for retaining said cigarette paper tube at said tubular holder when said tobacco leaves are fed into said cigarette paper tube, wherein said tube retainer comprises a spring-loaded pusher arm and a releasable unit for releasing an engagement between said pusher end of said pusher arm and said tubular holder, wherein said releasable unit comprises a pivot arm having a driving portion engaged with said pusher arm and an actuating portion located between said driving portion of said pivot arm and a pivot end thereof;

a cigarette filling arrangement, which comprises:

a feeding pusher slidably supported at said pocket casing to move along a transverse direction thereof which is perpendicular to said injection direction for pushing said tobacco leaves at said tobacco cavity, wherein said spring-loaded pusher arm is coupled at said feeding pusher and arranged in such a manner that when said feeding pusher is moved for pushing said tobacco leaves at said tobacco cavity, said pusher arm is driven to slide toward said tubular holder at a position that a pushing end of said pusher arm is biased against said tubular holder; and a slide spoon slidably coupled at said pocket casing at said injection direction to align with said feeding opening, wherein said feeding pusher is moved toward said slide spoon for pushing said tobacco leaves to said slide spoon, such that said slide spoon is slid for feeding said tobacco leaves at said tobacco cavity into said cigarette paper tube through said feeding opening, wherein after said slide spoon is slid for feeding said tobacco leaves into said cigarette paper tube, said actuating portion of said pivot arm is pushed by said slide spoon, such that said driving portion of said pivot arm is moved to drive said pusher arm to move away from said tubular holder for releasing said cigarette paper tube at said tubular holder.

2. The cigarette tube injector, as recited in claim 1, wherein said pocket casing further has a longitudinal spoon guiding slot for slidably guiding said slide spoon, wherein said actuating portion of said pivot arm is located at an end portion of said spoon guiding slot close to said feeding opening, such that after said slide spoon is slid to contact with said actuating portion of said pivot arm to move said pusher arm away from said tubular holder, said slid spoon is slid further to an end of said spoon guiding slot for pushing said cigarette paper tube out of said tubular holder.

* * * * *